United States Patent [19]

Gayso

[11] Patent Number: 4,796,686

[45] Date of Patent: Jan. 10, 1989

[54] CENTRIFUGAL CASTING MACHINE WITH VENTURI ACTUATED VACUUM VENTING

[76] Inventor: Donald W. Gayso, 1092 Perkins Ter., Memphis, Tenn. 38117

[21] Appl. No.: 898,381

[22] Filed: Aug. 20, 1986

[51] Int. Cl.[4] ..... B22D 13/10; B29C 7/84

[52] U.S. Cl. ..... 164/287; 164/410; 425/405.1; 425/425; 425/812; 425/DIG. 60

[58] Field of Search ..... 164/175, 286, 287, 289, 164/290, 305, DIG. 3, 61, 63, 65, 253–255; 425/425, 430, 434, 405 R, DIG. 60, 812, 405.1; 264/2.1

[56] References Cited

U.S. PATENT DOCUMENTS

| | | | |
|---|---|---|---|
| 2,442,718 | 6/1948 | Woock | 164/290 |
| 3,818,974 | 6/1974 | Eberle | 164/289 |
| 4,063,863 | 12/1977 | Hilmoe | 164/289 |

*Primary Examiner*—Willard E. Hoag

[57] ABSTRACT

A device affixed to a centrifical force casting machine that developes a vacuum as it travels through the air on the spinning arm of the casting machine. The developed vacuum is used to evacuate unwanted gasses from a casting mold.

2 Claims, 1 Drawing Sheet

CENTRIFUGAL CASTING MACHINE WITH VENTURI ACTUATED VACUUM VENTING

SUMMARY OF THE INVENTION

This invention is used with the art and science of the lost-wax technique. The said technique is utilized in the dental and jewelry field to cast items such as dental appliances and jewelry.

To make a casting using the lost-wax casting technique, a wax replica, called a wax pattern, of the desired item to be cast is first fabricated. A tubular piece of wax called a sprue is then connected to the wax pattern. The sprue will later form a passageway for molten metal to enter the casting mold cavity. The wax pattern with attached sprue is next placed inside a tubular open ended container called a casting ring. A porous heat resistent material is poured around the wax pattern and sprue. The porous heat resistent material is called casting investment.

After the casting investment hardens, the casting ring containing the wax pattern with the attached sprue and casting investment is placed in an oven. The oven burns out the wax and attached sprue. The remaining void from where the wax pattern and sprue has burned out of the investment forms the mold cavity into which molten metal will be cast.

One way the molten metal is cast into the mold cavity is by using centrifugal force. This is accomplished by using a centrifugal force casting machine.

When using a centrifugal force casting machine, the metal to be cast is melted in a container mounted on the casting arm of the casting machine, The said container is called a crucible. The casting ring containing the mold cavity is positioned on the the said casting arm in line with the orifice of the crucible. When the casting arm spins, the centrifugal force forces the molten metal from the crucible into the mold cavity. Thus the item is cast and is a metal reproduction of the wax pattern.

In order to get a good reproduction that is free from voids in the metal, unwanted gasses in the mold cavity must be evacuated. Most of the unwanted gasses were formed in the mold cavity during the wax pattern burn out process.

To assist in the evacuation of the unwanted gasses, the casting investments are manufactured to be of a porous nature. This allows the incoming molten metal to force the unwanted gasses out of the mold cavity and into the pores of the surrounding casting investment. If the molten metal solidifies before it completely evacuates the unwanted gasses from the mold cavity, a void in the metal reproduction occurs.

It has long been realized that a vacuum system attached to a centrifugal force casting machine to suck out the unwanted gasses can lessen the chances of voids in the metal and enhance the quality of the reproduction.

Prior attempts at attacting a vacuum suction system to a centrifugal force casting machine meant using vacuum pumps and special fittings to accommodate the spinning of the casting arm. This complicates and adds to the expense of the casting machine. My invention is an inexpensive vacuum system attached to a casting machine that does not require a vacuum pump or special fittings. The vacuum is produced by a venturi member type of vacuum system that produces a vacuum as it travels through the air as the casting arm of the casting machine spins.

DESCRIPTION OF THE PREFERRED EMBODIMENT

Figure 1:
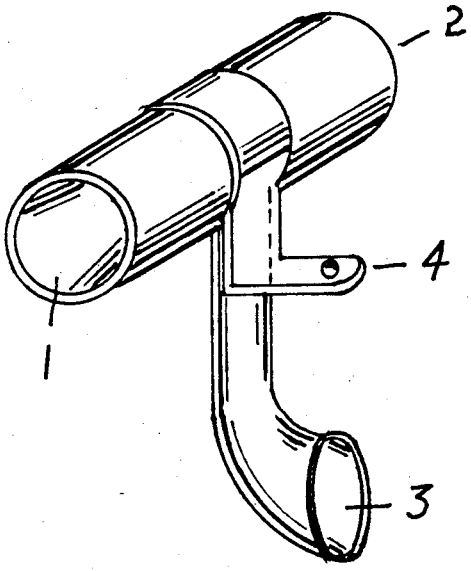
FIG. 1 is a perspective view of a venturi member type of suction device
Figure 2:
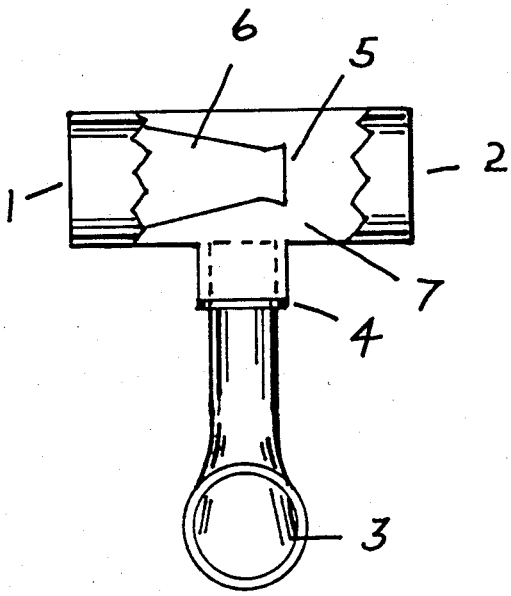
FIG. 2 is a side elevational view partly in section of a venturi member type of suction device
Figure 4:
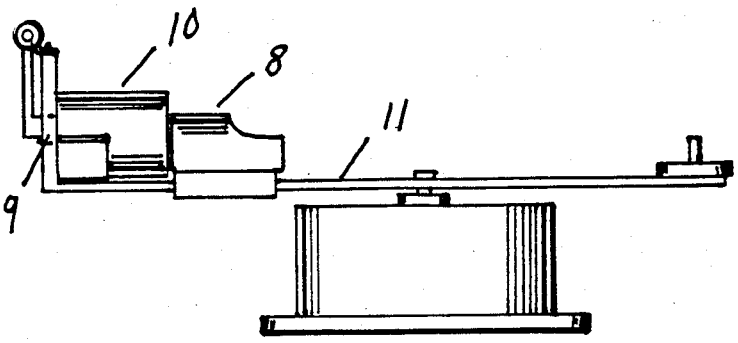
FIG. 4 is a side elevational view showing a venturi member type of suction device mounted on an associated casting arm of a centrifugal force casting machine with a casting ring and crucible in casting position.
Figure 3:
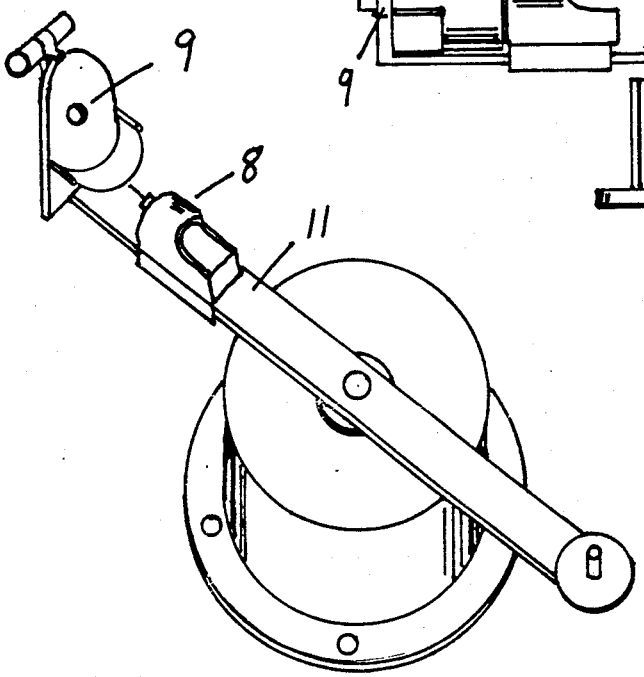
FIG. 3 is a perspective view showing a venturi member type of suction device mounted on an associated casting arm of a centrifugal force casting machine

In the perspective view of FIG. 1 is shown a venturi member type of suction device with mounting bracket 4. When in operation on the spinning casting arm assembly of a centrigugal force casting machine, air enters the said device at orifice 1. The velocity of the air is increased by being forced down a tapering tube member 6 of FIG. 2. The high velocity air exits the said tapering tube member from orifice 5. Prior to its' exit at orifice 2, the said high velocity air exerts a pull on the surrounding air of lower relative velocity contained in the chamber area 7. This developes a vacuum pull at 3, which makes suction at 9, FIG. 3 on the back plate of the casting arm assembly 11. The said suction at 9 pulls unwanted gasses from the casting mold cavity contained in the casting ring 10 of FIG. 4. Also shown in FIG. 4 is melting crucible 8.

The foregoing is just one type of venturi member vacuum system. It is realized that various embodiments may work for this invention equally as well and it is my intention that the following claim be given a scope commensurate with the broadest interpretation of the employed language.

I claim:

1. In a centrifugal molding apparatus having at least one mold defining a mold cavity, attached to an arm mounted for rotation, the improvement comprising: at least one venturi connected with said mold and mounted such that rotation of said arm will induce a negative pressure in said cavity to vent gases from said cavity.

2. The invention of claim 1 wherein said centrifugal molding apparatus is a centrifugal die casting machine.

* * * * *